US009296118B2

(12) United States Patent
Gerke et al.

(10) Patent No.: US 9,296,118 B2
(45) Date of Patent: Mar. 29, 2016

(54) DEVICE FOR GROOVING CARDBOARD CUTTINGS

(71) Applicant: Kolbus GmbH & Co. KG, Rahden (DE)

(72) Inventors: Klaus Gerke, Bassum (DE); Gerhard Lintelmann, Rahden (DE); Leonid Ugorets, Rahden (DE)

(73) Assignee: Kolbus GmbH & Co. KG, Rahden (DE)

( * ) Notice: Subject to any disclaimer, the term of this patent is extended or adjusted under 35 U.S.C. 154(b) by 181 days.

(21) Appl. No.: 14/067,299

(22) Filed: Oct. 30, 2013

(65) Prior Publication Data

US 2014/0123828 A1 May 8, 2014

(30) Foreign Application Priority Data

Nov. 2, 2012 (DE) ..... 10 2012 021 565

(51) Int. Cl.

| | |
|---|---|
| ***B26D 3/06*** | (2006.01) |
| ***B31B 1/25*** | (2006.01) |
| ***B42C 7/00*** | (2006.01) |
| *B26D 3/10* | (2006.01) |
| *B26D 5/08* | (2006.01) |
| *B26D 5/12* | (2006.01) |
| *B26D 7/00* | (2006.01) |

(52) U.S. Cl.

CPC . *B26D 3/065* (2013.01); *B31B 1/25* (2013.01); *B42C 7/005* (2013.01); *B26D 3/10* (2013.01); *B26D 5/086* (2013.01); *B26D 5/12* (2013.01); *B26D 2007/0043* (2013.01); *B31B 2201/25* (2013.01); *Y10T 83/0304* (2015.04)

(58) Field of Classification Search

CPC ..... B26D 3/065; B26D 2007/0043; B26D 5/086; B26D 5/12; B31B 1/25; B31B 2201/25; B24C 7/005; Y10T 83/0304

USPC ..... 83/105, 440, 443, 879, 883, 867, 865, 83/871, 881, 74, 72, 199, 425.2, 435.2, 83/240, 303, 496, 497, 523, 875–878

See application file for complete search history.

(56) References Cited

U.S. PATENT DOCUMENTS

| | | | | | |
|---|---|---|---|---|---|
| 4,091,697 | A | * | 5/1978 | Cailey | 83/865 |
| 4,342,349 | A | * | 8/1982 | Lipman | 144/371 |

FOREIGN PATENT DOCUMENTS

| | | | | |
|---|---|---|---|---|
| CN | 101 200 091 | B | | 8/2010 |
| CN | 201 566 176 | U | | 9/2010 |
| CN | 201 970 485 | U | | 9/2011 |
| CN | 201970485 | U | * | 9/2011 |
| CN | 202412794 | U | * | 9/2012 |

* cited by examiner

*Primary Examiner* — Ned Landrum
*Assistant Examiner* — Liang Dong
(74) *Attorney, Agent, or Firm* — Alix, Yale & Ristas, LLP

(57) ABSTRACT

A device (1) for grooving cardboard cuttings (2, 3) that features a driven, horizontally supported transport drum (11) and spaced-apart endless belts (51) that revolve around rollers (54.1 to 54.8) and effectively convey the cardboard cuttings (2, 3) by pressing them against the drum shell. Groove cutting tools (72) are arranged between the belts (51) at a defined distance from the drum shell and make it possible to produce grooves with essentially triangular cross section in the cardboard cuttings (2). In order to adjust the aperture angle of the grooves independently of one another, the adjustment of the angle within the respective groove cutting tool (72) is realized by curved guides (77). The center of curvature (81) of the curved guide (77) lies in the region of the drum shell, as well as in the region of the blade tip (71*a*) of the knife (71), such that the aperture angle and the depth of the groove can be adjusted independently of one another.

17 Claims, 3 Drawing Sheets

1
111
112
5
3
3a
15
51
54
6
72
36
71
11a
11
101
102
103
4
105
2
106
14
104.1
104.2
107
37
72

2
3a
11a
82
78
77
79a
79
72
83
75a
76a
76
75
73
74
87
36
71
80
71a, 81
71b,c
84
86

72
77
78'
88a
88b
81

DEVICE FOR GROOVING CARDBOARD CUTTINGS

BACKGROUND

The present invention pertains to a device for grooving cardboard cuttings.

Triangular grooves are cut into cardboard cuttings in order to prepare bending points and, in particular, sharp-edged bends on boxes. The aperture angle between the two groove flanks is also referred to as groove angle and defined by the cardboard thickness, the cardboard material and, if applicable, a single-sided or two-sided cloth cover, as well as the function of the cut grooves on the box to be produced of the cardboard cutting.

A cardboard grooving machine of this type is known from CN 101200091 B. In this case, the groove cutting tools are mounted in an axially adjustable fashion on support beams that lie parallel to the transport drum. They respectively feature two knives that are mounted obliquely to one another at a fixed angle on a knife receptacle. A change of the groove angle requires a time-consuming exchange of the respective knife receptacles for corresponding knife receptacles with a different angular position of the knives. Due to the changed knife position, cardboard hold-down devices and waste deflectors that are respectively arranged upstream and downstream of the groove cutting tools also need to be adjusted.

In the groove cutting machine described in CN 201970485 U, the support beam with the groove cutting tools can be pivoted about an axis that lies axially parallel in the region of the drum circumference. In this way, the blade angle of the groove cutting tools can be adjusted relative to the transport drum about a pivoting axis that extends approximately through the blade tips of their knives such that their respective cutting angle and the groove angle resulting thereof can be jointly changed. However, the cardboard hold-down devices and the waste deflectors still need to be adjusted and groove angles that are adjusted independently of one another cannot be realized.

SUMMARY

The object of the present invention is to provide a cardboard grooving machine that allows a user-friendly and separate adjustment of the groove cutting tools and their periphery.

The respectively desired groove angle can be adjusted on the groove cutting tools independently of one another without exchanging the knife receptacles.

This object is attained in that the knife receptacle can be adjusted by a curved guide in the groove cutting tool, wherein the center of curvature of the curved guide lies in the region of the drum surface.

The respective groove cutting tool does not have to be removed from the supporting beam in order to carry out this adjustment. The groove angle is adjusted within the respective groove cutting tool such that the supporting beam can be rigidly arranged in the frame and also used for other work equipment such as cardboard hold-down devices, waste deflectors, etc. The operator is able to easily pivot the knife receptacle in a reproducible fashion with respect to its effect on the groove angle in order to very quickly adjust a different groove angle on the respective groove cutting tool. The knife receptacle is repositionable along a curved track surface in the curved guide to adjust the groove aperture angle without adjustment of the knife in the knife receptacle.

If the center of curvature lies in the region of the blade tip of the at least one knife, the adjustment of the groove angle takes place independently of the cutting depth such that a distance correction between the at least one knife and the transport drum can be eliminated. The curved guide preferably defines a pivoting axis for the knife receptacle that extends parallel to the rotational axis of the drum.

The respectively required groove angle can be very quickly and reproducibly adjusted if the knife receptacle and/or the curved guide feature a scale with angular gradation that makes it possible to read out the groove angles resulting from certain angular adjustments of the knife receptacle.

A simple constructive design is achieved if the curved guide is realized in the form of a contact surface that extends along an arc and on which the knife receptacle can be fixed with the aid of clamping means. Cutting forces are reliably absorbed by the curved guide and transmitted to the supporting beam that is rigidly accommodated in the frame.

If the knife receptacle is realized in the form of an exchangeable part, worn-out knives can be quickly and easily replaced. A new knife set can already be preinstalled and aligned on a second knife receptacle. This furthermore makes it possible to hold ready different knife shapes and knife arrangements that can be selectively utilized.

An optional cutting depth adjustment can be realized if the curved guide is essentially accommodated in the groove cutting tool such that it can be adjusted radially to the transport drum. The knife receptacle itself does not require any adjustments and readjustments to this effect.

If the curved guide is accommodated in the groove cutting tool such that it can be adjusted axially to the transport drum, the groove position in the cardboard cutting can be corrected without having to shift the groove cutting tool on the supporting beam.

The waste sections accumulating during groove cutting are transported away from the transport drum and the cardboard cutting by means of a deflection plate that is arranged on the curved guide separately of the knife receptacle downstream of the at least one knife, namely regardless of whether the cardboard cuttings are transported past the groove cutting tools from the top toward the bottom or from the bottom toward the top. Since the position of the blade tip of the at least one knife relative to the curved guide essentially remains unchanged when the groove angle is changed, it is not necessary to readjust the deflection plate mounted on the curved guide.

The deflection plate is preferably realized in the form of a waste lift-out device in order to remove waste sections adhering in the groove, if so required. According to an enhancement, the deflection plate transforms into a deflection channel that essentially extends away from the transport drum radially and through which the waste sections can be removed from the cardboard grooving machine. The advantage of a significantly reduced dust exposure can be achieved if the deflection channel is connected to a disposal unit for the waste sections.

In order to prevent a groove that widens toward the edge of the cardboard, particularly the leading edge of the cardboard cutting is pressed against the drum shell by means of a pressing element that is arranged on the curved guide separately of the knife receptacle and holds down the cardboard cutting against the drum shell in the region of the at least one knife. Since the position of the blade tip of the at least one knife relative to the curved guide essentially remains unchanged when the groove angle is changed, it is not necessary to readjust the pressing element mounted on the curved guide. The pressing element preferably holds down the cardboard cutting upstream of the at least one knife in the region of the subsequently cut groove. Any stress marks of the pressing element that might become apparent on the cardboard cutting are irrelevant because they are cut out of the cardboard cutting in the form of a groove waste section. If the pressing element is spring-loaded, different cardboard thicknesses can be processed on the pressing element without requiring any adjusting effort. According to an enhancement, the pressing element is realized in the form of a deflection plate, by means of which waste sections accumulating during groove cutting are deflected from the transport drum.

BRIEF DESCRIPTION OF THE DRAWING

An exemplary embodiment of the inventive grooving device is described in greater detail below with reference to the drawing, in which.

DETAILED DESCRIPTION

Figure 1:
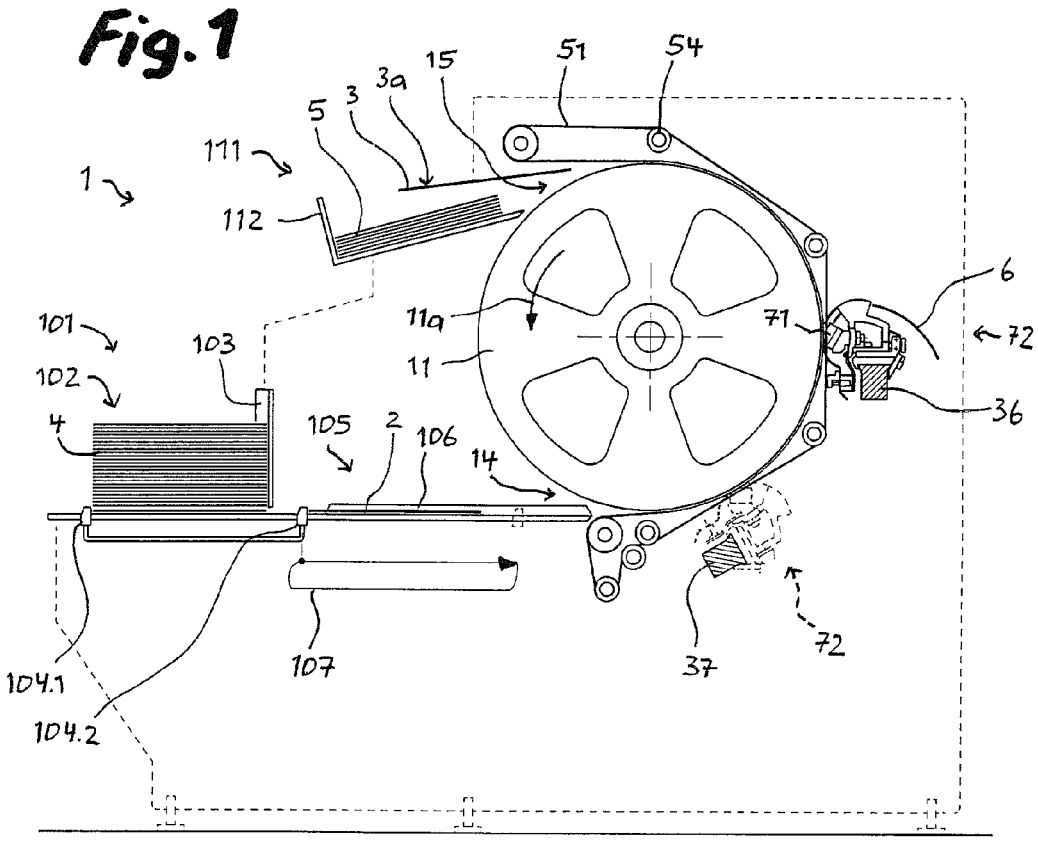
FIG. 1 shows a grooving device in the form of a schematic side view.

The grooving device 1 schematically illustrated in FIG. 1 is comprised of a driven, horizontally supported transport drum 11 and several spaced-apart endless belts 51 that revolve around rollers 54 and are partially looped around the transport drum 11 such that an inlet 14 and an outlet 15 are formed, as well as groove cutting tools 72 that are arranged between the belts 51 at a defined distance from the drum shell. Cardboard cuttings 2 fed to the inlet 14 by a feed device 101 are effectively conveyed by being pressed against the drum shell by the belts 51, wherein said cardboard cuttings are conveyed from the inlet 14 situated in the lower vertex of the transport drum 11 to the outlet 15 situated in the upper vertex in the transport direction 11*a* during an approximately 180° rotation of the transport drum 11 and during this process guided past the cutting tools 72, at which a waste section 6, for example, with essentially triangular cross section is cut out of the cardboard cuttings 2 with correspondingly designed grooving knives 71.

The feed device 101 in FIG. 1 features a cardboard magazine 102 containing a stack 4 of cardboard cuttings that lie on top of one another. The respective bottom cardboard cutting 2 is ejected underneath a front stop 103 by a first cardboard pusher 104.1 and transferred into an intermediate position 105, from which the cardboard cutting 2 is fed to the inlet 14 by a second cardboard pusher 104.2 and simultaneously aligned on outer guide rails 106. The cardboard pushers 104.1, 104.2 are coupled at a fixed distance from one another and cyclically moved back and forward with a constant feed stroke 107 that corresponds to this distance. In this case, the feed rate is identical to the rotational speed of the transport drum 11 or slightly higher such that the cardboard cuttings 2 are in a manner of speaking forcibly pushed into the inlet 14 between the transport drum 11 and the belts 51.

The delivery 111 in FIG. 1 features a delivery table 112 that slopes forward, wherein the completely grooved cardboard cuttings 3 exiting the outlet 15 are dropped onto the delivery table and placed on top of one another in order to form a stack 5. Due to the arrangement of the outlet 15 in the upper vertex of the transport drum 11, the cut grooves 3*a* are situated on the upper side of the exiting cardboard cuttings 3 and therefore visible to the operator.

According to FIG. 1, the rollers 54 are arranged around the transport drum 11 in such a way that a total of three areas of closest approach between the segments that lie between the rollers 54 and the belt section adjoining the transport drum 11 are formed. The groove cutting tools 72 may be arranged in these areas. The groove cutting tools 72 are mounted on supporting beams 36, 37 that lie parallel to the transport drum 11. Several groove cutting tools 72 may be mounted adjacent to one another. Grooves 3*a* that lie very close to one another can be produced due to the arrangement on two supporting beams 36, 37 that lie behind one another in the transport direction 11*a*.

Figure 2A:
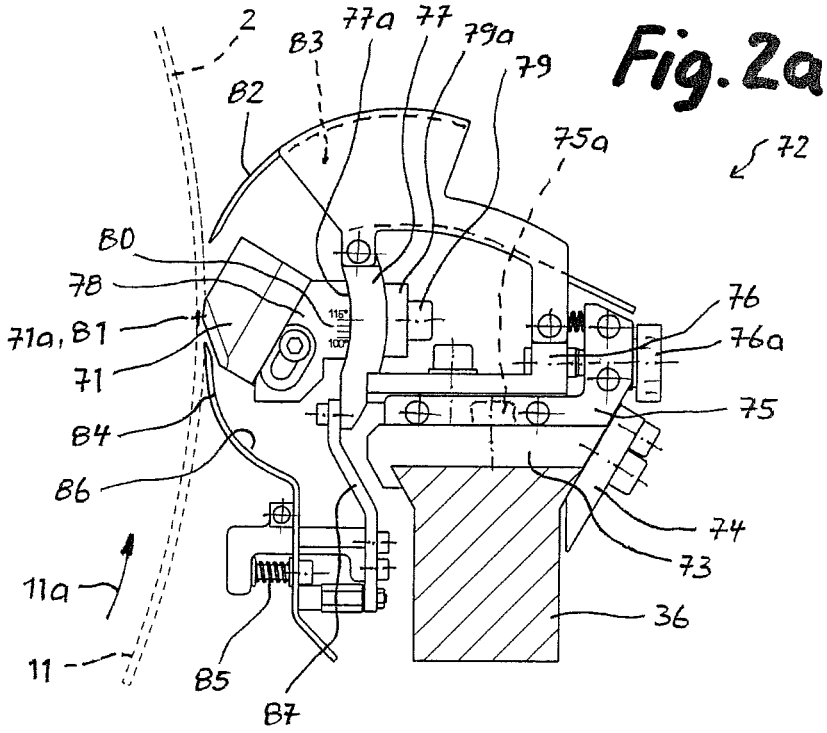
FIG. 2*a* shows a groove cutting tool of the grooving device with a knife receptacle in a first angular position.
Figure 2B:
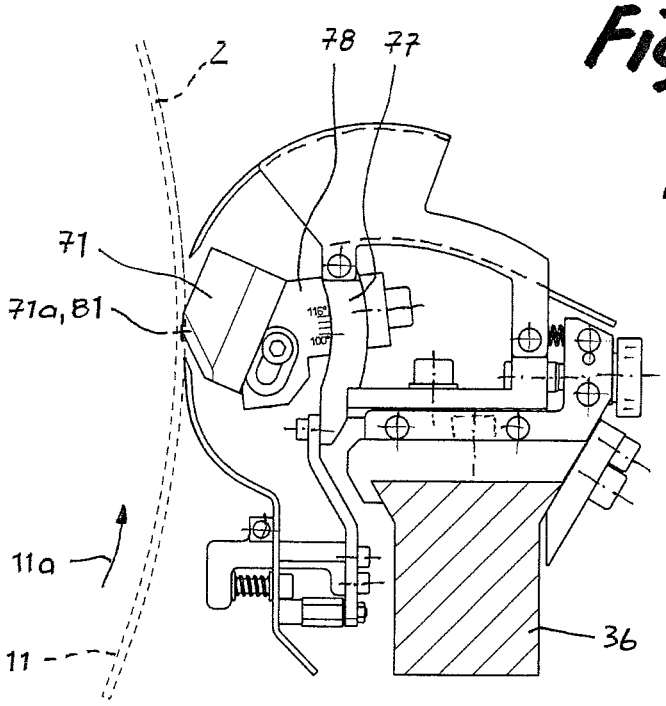
FIG. 2*b* shows the groove cutting tool with the knife receptacle in a second angular position.

FIGS. 2*a* and 2*b* show the inventive groove cutting tool 72 according to FIG. 1 on an enlarged scale. It features a carrier 73 that can be fixed on the supporting beam 36 with a clamping block 74. A slide 75 that can be precisely adjusted axially to the transport drum 11 by means of an eccentric screw 75*a* is guided and can be fixed on the carrier 73. This slide in turn carries a slide 76 that can be displaced radially to the transport drum 11 and likewise fixed by means of a knurled thumb screw 76*a*, wherein the curved guide 77 is arranged on the latter slide. A knife receptacle 78 abuts on the arc-shaped contact surface 77*a* of the curved guide with a contact surface of complementary curvature. This is in essence establishes a track for guiding the receptacle 78 along a preestablished curved path relative to the guide 77. The knife receptacle is then fixed on the curved guide 77 by a clamping screw 79 and a washer 79*a*. The grooving knife 71 is ultimately fixed on the knife receptacle 78.

The center of curvature 81 of the curved guide 77 lies in the blade tip 71*a* of the grooving knife 71, i.e., effectively on the circumference of the transport drum 11. After loosening the clamping screw 79, the knife receptacle 78 can be adjusted into a different angular position in accordance with the scale 80 (see FIGS. 2*a* and 2*b*). During this process, the knife receptacle 78 and the grooving knife 71 are jointly pivoted about a pivoting axis that extends through the center of curvature 81 and parallel to the transport drum 11. During this process, the position of the blade tip 71*a* and therefore its distance from the transport drum 11 remains unchanged. The cutting depth that can be adjusted by the knurled thumb screw 76*a* remains constant, but a different groove angle results due to the changed angular adjustment of the knife receptacle 78 on the curved guide 77.

A deflection plate 82 for waste sections 6 accumulating during groove cutting is situated on the curved guide 77 that can be radially adjusted in accordance with the desired cutting depth downstream of the grooving knife 71, wherein the front end of said deflection plate is realized in the form of a waste lift-out device that extends as far as the vicinity of the blade tip 71*a* of the grooving knife 71 and on the other end transforms into a deflection channel 83 that extends over the groove cutting tool 72 and, in essence, radially to the transport drum 11. The deflection channel may be connected to a not-shown waste section disposal unit. The deflection plate 82 remains in its fixed position when the groove angle is changed.

A cardboard hold-down device 84 is provided upstream of the grooving knife 71. It is pivotably accommodated separately of the knife receptacle 78 on a holder 87 arranged on the curved guide 77 and presses the cardboard cutting 2 against the drum shell in the region of the grooving knife 71 under the influence of a pressure spring 85 such that a flawlessly cut groove is ensured on the cardboard edge. The end of the cardboard hold-down device 84 that presses against the cardboard cuttings 2 only acts as a pressing element in the region of the subsequently cut groove. Outside the pressure point, the cardboard hold-down device 84 widens toward the deflection plate 86 for waste sections that might fall down during groove cutting.

Figure 3:
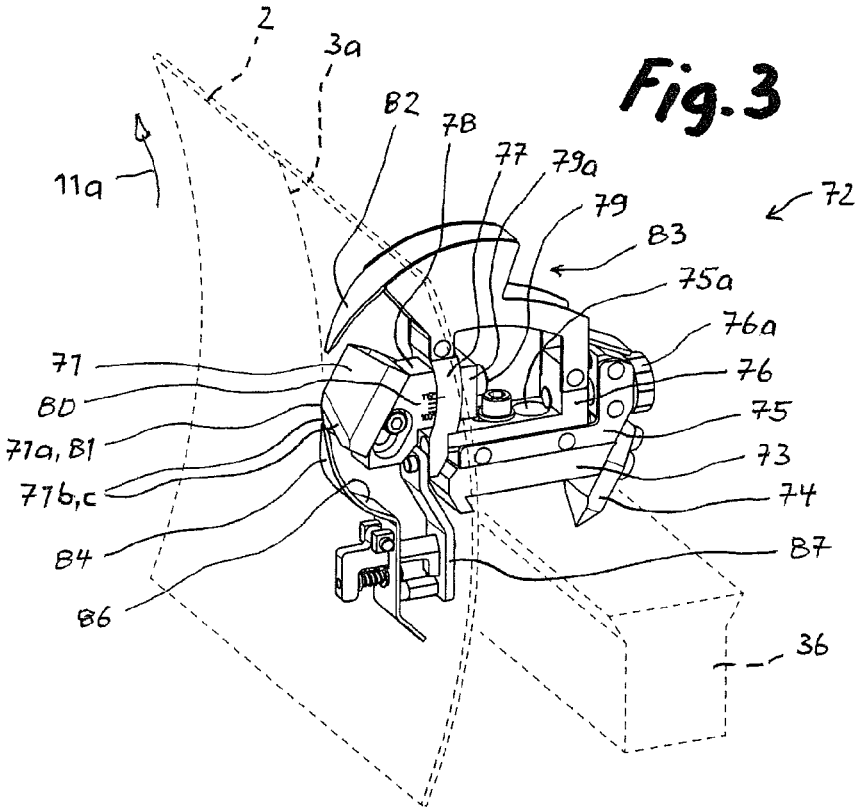
FIG. 3 shows the groove cutting tool in the form of a perspective representation.
Figure 4:
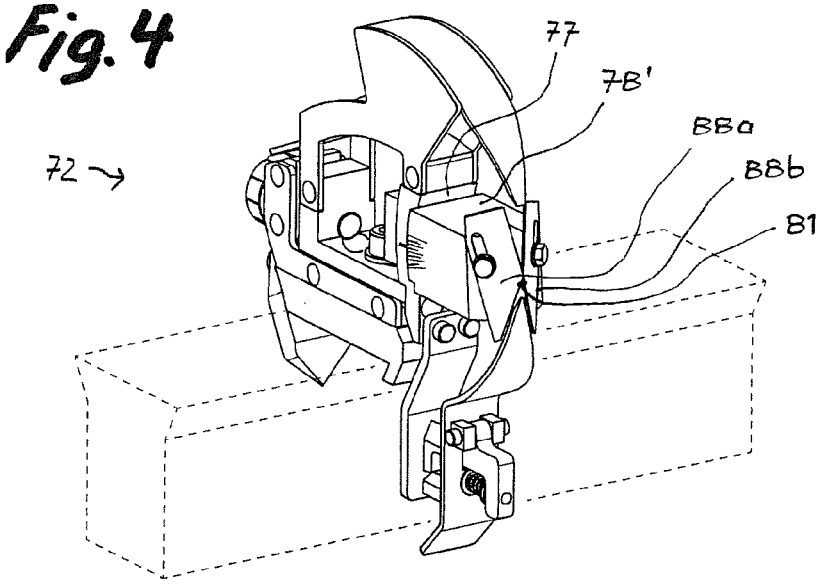
FIG. 4 shows the groove cutting tool from a different perspective and with an alternative knife arrangement.

FIGS. 3 and 4 respectively show views of the grooving knives from different perspectives. In FIG. 3, the groove cutting tool 72 is fitted with a one-piece grooving knife 71. It comprises a knife with two blades 71*b, c* that respectively are externally sharpened and connected into a V-shaped wing. The blades are connected into a closed annular body by a bridge in order to form a waste section deflection channel. The grooving knife 71 can be very easily resharpened and readjusted with respect to a constant blade tip 71*a* on the knife receptacle 78 by means of a simple sliding fit. It is not necessary to adjust any individual knife blades relative to one another. The blades connected into a V reliably lift the waste sections out of the groove 3*a* and deflect these waste sections away from the cardboard cutting 2 and the transport drum 11. Trimming of the blade tip 71*a* also makes it possible to cut trapezoidal grooves with the grooving knife 71.

In FIG. 4, the knife receptacle 78 with the grooving knife 71 illustrated in the other figures is replaced with a knife receptacle 78' that features the same interface with the curved guide 77 and is fitted with two individual knives 88*a, b*. This arrangement also makes it possible to cut grooves 3*a* with essentially triangular cross section.

Since the knife receptacle 78 is realized in the form of an exchangeable part, worn-out grooving knives 71 or 88*a, b* can be quickly replaced. In addition, it is possible to utilize special knife shapes and/or special knife arrangements, for example, in order to cut semicircular grooves, undercut grooves such as dovetail grooves, etc. Furthermore, slitting knives and perforating knives can also be used on the groove cutting tool 7.

The invention claimed is:

1. A device for grooving cardboard cuttings (2), comprising:

a rotationally driven, horizontally supported transport drum (11) having an outer surface;

a plurality of spaced-apart endless belts (51) that revolve around rollers (54), and are partially looped around the transport drum (11) such that an inlet (14) and an outlet (15) for the cardboard cuttings are formed and the belts effectively convey the cardboard cuttings (2) by pressing the cardboard cuttings against the outer surface of the drum; and at least one groove cutting tool (72) positionable between the belts (51) on the outer surface of the transport drum (11) and including a knife receptacle (78) that carries at least one knife (71) which together define a groove aperture angle for grooving the cuttings;

wherein said groove cutting tool (72) includes a curved guide (77) for the knife receptacle (78), said curved guide defines a curved surface to guide movement of the knife receptacle along a curved path to adjust the groove aperture angle, and said curved surface of the guide has a center of curvature (81) which lies at the transport drum surface; and wherein the curved surface of the guide (77) is a contact surface (77*a*) that extends along an arc and on which the knife receptacle (78) has a complementary contact surface for said guided movement that can be fixed with a clamp (79, 79*a*).

2. The device according to claim 1, wherein each knife has a blade tip (71*a*) and the center of curvature (81) is substantially at the blade tip (71*a*).

3. The device according to claim 1, wherein the curved guide (77) defines a pivoting axis for the knife receptacle (78) that extends parallel to the rotational axis of the drum.

4. The device according to claim 1, including a scale (80) with angular gradation indicative of the angular relationship between the knife receptacle (78) and the curved guide (77).

5. The device according to claim 1, wherein the knife receptacle (78) is an exchangeable part.

6. The device according to claim 1, wherein the curved guide (77) is adjustably supported in the groove cutting tool (72) for radially repositioning relative to the transport drum (11).

7. The device according to claim 1, wherein the curved guide (77) is adjustably supported in the groove cutting tool (72) for axial repositioning relative to the transport drum (11).

8. The device according to claim 1, including a deflection plate (82) for waste sections (6) of cardboard accumulated during groove cutting, arranged on the curved guide (77) separately of the knife receptacle (78) downstream of the at least one knife (71).

9. The device according to claim 8, wherein the deflection plate (82) is a waste section lift-out device.

10. The device according to claim 8, wherein the deflection plate (82) transitions into a deflection channel (83) that extends away from the transport drum (11) radially.

11. The device according to claim 1, including a pressing element (84) arranged on the curved guide (77) separately of the knife receptacle (78) and having a free end that holds the cardboard cutting (2) against the drum surface upstream of the at least one knife (71).

12. The device according to claim 11, wherein the pressing element (84) holds down the cardboard cutting (2) immediately upstream of the center of curvature (81).

13. The device according to claim 11 wherein the pressing element (84) is spring-loaded.

14. The device according to claim 11, wherein the pressing element (84) includes a deflection plate (86) for waste sections accumulating during groove cutting.

15. The device according to claim 1, wherein the knife receptacle (78) is moveable along said curved surface in the curved guide (77) to adjust the groove aperture angle without adjustment of the knife (71) in the knife receptacle.

16. The device according to claim 2, wherein the curved guide (77) defines a pivoting axis for the knife receptacle (78) that extends parallel to the rotational axis of the drum.

17. The device according to claim 2, including a plurality of said cutting tools (72) guided by a respective plurality of said curved guides (77), whereby the groove aperture angle of each cutting tool is independently adjustable.

* * * * *